US007501751B2

(12) United States Patent
Kijima et al.

(10) Patent No.: US 7,501,751 B2
(45) Date of Patent: Mar. 10, 2009

(54) DISPLAY DEVICE AND METHOD OF MANUFACTURING SAME

(75) Inventors: Yuuichi Kijima, Chosei (JP); Yoshiyuki Kaneko, Hachioji (JP); Shigemi Hirasawa, Chiba (JP)

(73) Assignee: Hitachi Displays, Ltd., Chiba (JP)

( * ) Notice: Subject to any disclaimer, the term of this patent is extended or adjusted under 35 U.S.C. 154(b) by 0 days.

(21) Appl. No.: 11/738,938

(22) Filed: Apr. 23, 2007

(65) Prior Publication Data

US 2007/0188076 A1 Aug. 16, 2007

Related U.S. Application Data

(63) Continuation of application No. 11/052,635, filed on Feb. 7, 2005, now abandoned.

(30) Foreign Application Priority Data

Feb. 9, 2004 (JP) ..... 2004-032213

(51) Int. Cl.
*H01J 63/04* (2006.01)
*H01J 1/62* (2006.01)

(52) U.S. Cl. ..... 313/496; 313/497; 313/292

(58) Field of Classification Search ..... None
See application file for complete search history.

(56) References Cited

U.S. PATENT DOCUMENTS 5,754,003 A 5/1998 Murai et al.
5,811,927 A 9/1998 Anderson et al.
6,126,505 A 10/2000 Narayanan et al.
6,605,893 B2 8/2003 Ando
6,611,312 B2 8/2003 Kijima et al.
6,958,570 B2 * 10/2005 Kijima et al. ..... 313/292
7,078,854 B2 * 7/2006 Niibori et al. ..... 313/495

FOREIGN PATENT DOCUMENTS

| | | |
|---|---|---|
| JP | 10-302685 | * 11/1998 |
| JP | 11-317164 | 11/1999 |
| JP | 2000-311630 | 11/2000 |
| JP | 2002-298761 | 10/2002 |
| KR | 1999-0043895 | 6/1999 |

* cited by examiner

*Primary Examiner*—Ashok Patel
(74) *Attorney, Agent, or Firm*—Milbank, Tweed, Hadley & McCloy LLP

(57) ABSTRACT

The present invention ensures the hermetic bonding of a support body which is interposed between a face substrate and a back substrate and is formed of a plurality of members thus easily realizing the large-sizing of a screen of a display image and, at the same time, enhancing a hermetic property holding function of the image display device. A support body is interposed between a face substrate and a back substrate while surrounding a display region and hermetically seals both substrates using a sealing material. The support body is formed by hermetically bonding a plurality of support body members each other using a bonding material which has a softening point higher than a softening point of the sealing material.

6 Claims, 6 Drawing Sheets

DISPLAY DEVICE AND METHOD OF MANUFACTURING SAME

This application is a continuation of application Ser. No. 11/052,635, filed Feb. 7, 2005 now abandoned, the entire disclosure of which is hereby incorporated by reference.

BACKGROUND OF THE INVENTION

The present invention relates to an image display device, and more particularly to an image display device which is provided with a support body which is interposed between substrates and surrounds a sealed space.

As an image display device which exhibits excellent properties, such as high brightness and high definition, a color cathode ray tube has been conventionally used.

Further, along with the enhancement of the quality of information processing equipment and television broadcasting in recent years, there has been a demand for a panel display which is a lightweight and space-saving image display device that also possessing excellent properties such as high brightness and high definition.

As a typical example, a panel display such as a liquid crystal display device, a plasma display device or the like has been commercialized.

With respect to this type of panel display, as a display device which is capable of exhibiting particularly high brightness, various types of panel displays, such as a field (electron) emission display device and an organic EL display device which is characterized by low power consumption, have been proposed.

Among these panel-type display devices, in a display device, which defines a sealed space between two substrates consisting of a face substrate and a back substrate and sets the pressure inside the sealed space lower than an external atmospheric pressure or evacuates the sealed space, a frame-like support body is arranged to hold a gap between two substrates at a given value and maintains the hermetic property by surrounding the sealed space.

FIG. 8 is a cross-sectional view for explaining one constitutional example of a known field emission image display device. In FIG. 8, the field emission image display device includes a back substrate 1 and a face substrate 2 which faces the back substrate 1 in an opposed manner. Further, a frame-like support body 3 which is constituted of an integral body is interposed between inner peripheral portions of both substrates and is also adhered to the inner peripheral portions of both substrates using a sealing material 4. Further, an inner space which is hermetically defined by both substrates and the support body and constitutes a display region is held at a pressure lower than the external atmospheric pressure or in a vacuum state.

The image display device includes field-emission-type electron sources 5, control electrodes and the like on an inner surface of the back substrate 1. The image display device also includes an anode and a phosphor layer 6 on an inner surface of the face substrate 2. Further, numeral 7 indicates spacers and these spacers 7 are provided for maintaining a distance between both substrates within the above-mentioned display region. These spacers 7 are indispensable these days along with the large-sizing or the increase in size of the display screen.

The back substrate 1 is formed of preferably a material such as glass or ceramic, while the face substrate 2 is formed of a light-transmitting material such as glass. Further, the support body 3 is formed of preferably a material such as glass or ceramics and is fixedly secured to the inner peripheries of the back substrate 1 and the face substrate 2 using the sealing material such as glass frit. The inner space defined by the back substrate 1, the face substrate 2 and the support body 3 is evacuated to create the degree of vacuum of, for example, $10^{-5}$ to $10^{-7}$ Torr.

Further, the above-mentioned electron sources 5 are constituted of, for example, carbon nanotubes (CNT), diamond-like carbon (DLC) or other field emission cathode.

In such a panel display, with respect to the support body which surrounds the display region while holding the distance between both substrates, there has been known the above-mentioned support body which is integrally formed and a support body which is shown in FIG. 9 as an example in which the support body is formed by joining a plurality of wall members.

FIG. 9 is an explanatory view of a display device which is disclosed in JP-A-2002-298761 and also is a developed perspective view for schematically explaining a constitutional example of a back substrate 1, a face substrate 2 and a support body 3.

In the display device shown in FIG. 9, the back substrate 1 and the face substrate 2 are formed of a glass plate, while the support body 3 is formed of a glass material. Here, various kinds of constitutional parts which are formed on respective inner surfaces of the back substrate 1 and the face substrate 2 are omitted from the drawing.

In FIG. 9, the support body 3 having a given thickness is interposed between peripheries of the back substrate 1 and the face substrate 2 and these members are fixed to each other using a sealing material with a fixed gap between the back substrate 1 and the face substrate 2, thus, forming a sealed space in the inside thereof. The support body 3 is divided into a plurality of wall members 3X1, 3X2, 3Y1, 3Y2 and 3C1 to 3C4.

On respective portions of the respective wall members 3X1, 3X2, 3Y1, 3Y2 and the 3C1 to 3C4 which are arranged close to each other and are also engaged with each other, oblique surfaces 3P are formed. Further, a crossing angle between a normal line which is erected from the oblique surface 3P and a normal line which is erected from the back substrate 1 or the face substrate 2 is set to an acute angle.

Further, FIG. 10A, FIG. 10B and FIG. 10C are views which respectively show a front surface and two side surfaces of the support body shown in FIG. 9, wherein FIG. 10A is a plan view, FIG. 10B is a lateral side view, and FIG. 10C indicates a longitudinal side view.

Numerals in the drawing indicate parts which are identical with the parts shown in FIG. 9.

As shown in FIG. 10A to FIG. 10C, the support body 3 of this example is divided into two long-side wall members 3X1 and 3X2, two short-side wall members 3Y1 and 3Y2, and four corner wall members 3C1, 3C2, 3C3, 3C4, wherein these members are adhered to each other along the respective oblique surfaces 3*p* thus constituting the support body 3.

Further, JP-A-2000-311630 describes a technique in which a support body includes a first frame member which encloses electron emission elements and a second frame member which encloses the first frame member, these first and second frame members are formed by arranging, positioning and fixing a plurality of plate-like members in a rectangular shape, melting respective contact portions by heating with a burner and, thus, joining the contact portions by welding.

Still further, JP-A-11-317164 discloses a technique on an image forming device having an integral-structure-type support frame, wherein by providing the sealing between a face plate and spacers, between a back plate and the spacers and between the support frame and both of front plate and back plate using glass frit which has different softening points, the number of sealing can be reduced and, hence, the size change can be minimized, whereby the occurrence of minute leaking of liquid crystal can be suppressed.

SUMMARY OF THE INVENTION

In the above-mentioned related art, with respect to the display device to which two glass plates are adhered and fixed by way of the integrally-formed, frame-type support body, when the display device becomes large-sized (large sizing of the screen), the support body is liable to be easily broken at the time of handling thereof. Further, waste members are produced at the time of producing materials of constituting parts, thus, giving rise to a drawback of increased manufacturing cost.

To avoid such a drawback, there has been also proposed a technique, as shown in FIG. 9, in which the support body is divided into a plurality of members, and these members are assembled and adhered to each other.

Assembling and adhering the member of the support body has an advantage of overcome the drawback of easily breaking as compared to the integrally-formed, frame-type support body and, at the same time, can avoid the occurrence of waste members at the time of producing materials that constitute the support body members, thus, reducing costs.

However, at the time of sealing both substrates and the support body by way of the sealing material, a load is applied to both substrates, respectively, in the direction perpendicular to plate surfaces (Z direction). At the time of performing this adhesion under pressure, the joining portions of the respective divided members of the support body are displaced in the directions (X, Y directions) in which the joining portions are spaced apart from each other and, hence, the maintenance of hermetic property or air tightness of the joining portions becomes insufficient, leading to the occurrence of leaking of liquid crystal. Accordingly, the use of a jig for preventing the occurrence of leaking becomes indispensable.

Further, the high-temperature atmosphere is generated even in the evacuation step after sealing, and hence, there exists a possibility that an adhesive material of the joining portion melts, thus giving rise to a drawback requiring reuse of a jig which restricts the displacement of respective divided members of the support body. The solution of this drawback has been one of the tasks of this technical field.

Further, in the technique of the related art in which the plurality of plate-like members are arranged in a rectangular shape and are positioned and fixed, and the respective contact portions are heated and melt by burners, thus forming the support body by welding, a shaping step to cope with the occurrence of the deformation attributed to welding, is inevitably required, a drawback on the operational environment. In light of this drawback, the adoption of the related art is avoided and the technique which fixes members of the support body using the adhesive material has been favorably used.

Accordingly, the present invention has been made to overcome the above-mentioned conventional drawbacks and can solve the above-mentioned drawbacks by providing an image display device which performs hermetic sealing of end surfaces of a support body and a face substrate and a back substrate using a sealing material, wherein the support body is constituted of a mass of a plurality of support body members, and the support body members are hermetically bonded to each other using a bonding material which differs from the sealing material.

Accordingly, the leaking of liquid crystal is hardly generated and, hence, it is possible to provide the image display device which can perform a desired high quality display and also can easily realize the large-sizing of the screen for the display image.

According to the present invention, by separately using the sealing material and the bonding material for different purposes, it is possible to ensure the hermetic bonding between the support body members and hence, it is possible to obviate the possibility of the occurrence of leaking of liquid crystal, thus, realizing the acquisition of the large-sized (large-screen) display device with high definition.

Further, since the support body is constituted of the mass of the plurality of support body members, a rupturing defect, which has been the drawback of the integrally-formed support body, can be overcome. Further, it is also possible to obviate the waste material with respect to the preparation of materials for support body members and, hence, the support body can be manufactured at a low cost, thus, realizing the acquisition of the large-sized (large-screen) display device with the high definition.

According to the present invention, the displacement between the support body members is hardly generated at the time of performing the sealing, the evacuation and the like and hence, the hermetic property can be ensured whereby the use of the above-mentioned jig is no longer indispensable. Accordingly, it is possible to enhance the operability and, at the same time, it is possible to acquire the large-sized (large-screen) display device with the high definition.

According to the present invention, it is possible to ensure the maintenance of the hermetic property between the support body members as well as between the support body and both substrates whereby it is possible to acquire the large-sized (large-screen) display device with the high definition.

According to the present invention, the support body members are preliminarily hermetically bonded to each other using the bonding material thus forming the support body, and, thereafter, the support body is hermetically sealed with both substrates using the sealing material. Accordingly, even when a temperature of the support body is elevated to the desired high temperature during steps after sealing, the hermetic bonding between the support body members can be ensured, whereby it is possible to acquire the large-sized (large-screen) display device with the high definition.

According to the present invention, the displacement between the support body members is hardly generated at the time of performing the sealing, the evacuation and the like and hence, the hermetic property can be ensured, whereby the use of the above-mentioned jig is no more dispensable. Accordingly, it is possible to enhance the operability and, at the same time, it is possible to acquire the large-sized (large-screen) display device with the high definition.

According to the present invention, it is possible to ensure the maintenance of hermetic property between the support body members as well as between the support body and both substrates, and hence, it is possible to acquire the large-sized (large-screen) display device with the high definition.

BRIEF DESCRIPTION OF THE DRAWINGS

FIG. 3A and FIG. 3B show one example of a support body of another embodiment of the image display device according to the present invention, wherein FIG. 3A is a plan view and FIG. 3B is a front view;

FIG. 5A and FIG. 5B show another example of a support body of still another embodiment of the image display device according to the present invention, wherein FIG. 5A is a plan view and FIG. 5B is a front view;

DETAILED DESCRIPTION OF THE INVENTION

Figure 1:
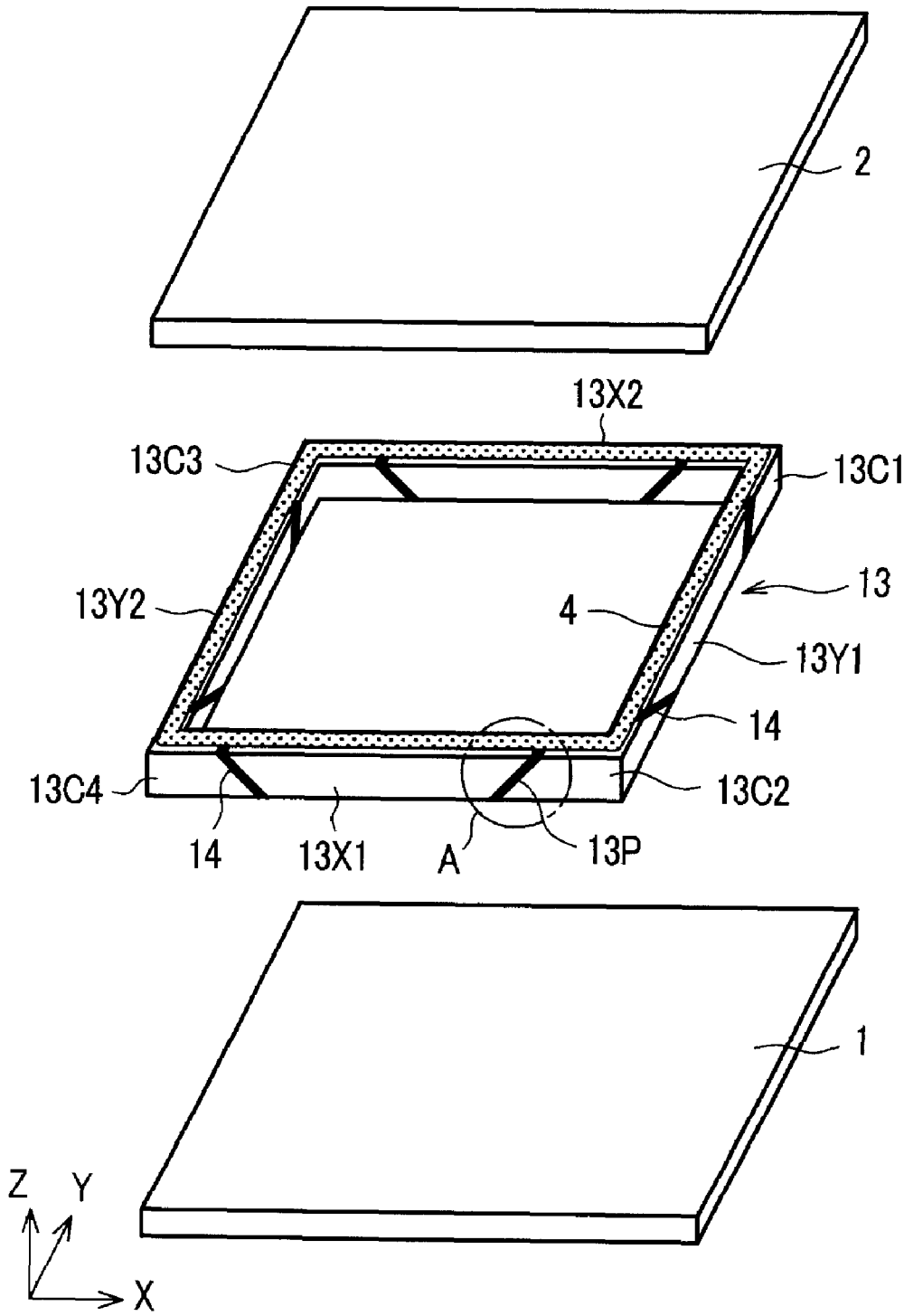
FIG. 1 is a developed perspective view for schematically explaining one embodiment of an image display device according to the present invention.

An image display device according to the present invention is characterized in such a way that a support body, which is interposed between both substrates and surrounds a display region, is constituted of a mass of a plurality of support body members, and, at the same time, a bonding material which hermetically bonds the support body members and a sealing material have properties different from each other.

Typical constitutions of the image display device according to the present invention, are described as follows.

In the image display device which includes a face substrate which forms an anode and a phosphor on an inner surface thereof, a back substrate which forms a plurality of electron sources on an inner surface thereof and faces the face substrate with a given distance therebetween, and a support body which is interposed in a state that the support body surrounds the display region between the face substrate and the back substrate and holds the given distance, and in which end surfaces of the support body and the face substrate and the back substrate are hermetically sealed respectively using a sealing material, the improvement is characterized in that the support body which is constituted of a plurality of support body members, and the support body members which are hermetically bonded to each other using a bonding material.

Further, in the image display device according to the present invention, the bonding material is configured to have a softening point higher than a softening point of the sealing material and the softening point difference is set to 30° C. or more.

Still further, the bonding material and the sealing material are made of glass frit.

Further, in a manufacturing method of an image display device according to the present invention which manufactures an image display device which includes a face substrate which forms an anode and a phosphor on an inner surface thereof, a back substrate which forms a plurality of electron sources on an inner surface thereof and faces the face substrate with a given distance therebetween, and a support body which is interposed in a state that the support body surrounds the display region between the face substrate and the back substrate and holds the given distance, and in which end surfaces of the support body and the face substrate and the back substrate are hermetically sealed respectively using a sealing material, the improvement lies in the support body which is constituted of a plurality of support body members, the support body members which are hermetically bonded to each other using a bonding material and, thereafter, the face substrate and the back substrate which are respectively hermetically sealed using a sealing material.

Due to the above-mentioned constitution, it is possible to realize the image display device which can exhibit the excellent hermetic property holding function, can perform the high quality display, and still can make the screen large-sized.

Here, it is needless to say that the present invention is not limited to the above-mentioned constitution and the constitution of embodiments described later and various modifications can be made without departing from the technical concept of the present invention.

EMBODIMENT 1

Hereinafter, the embodiments of the present invention are explained in detail in conjunction with drawings.

Here, although the explanation is made with respect to a case in which the present invention is applied to an FED (field emission type display device), the present invention is applicable to other similar display device and other similar equipment.

Figure 2:
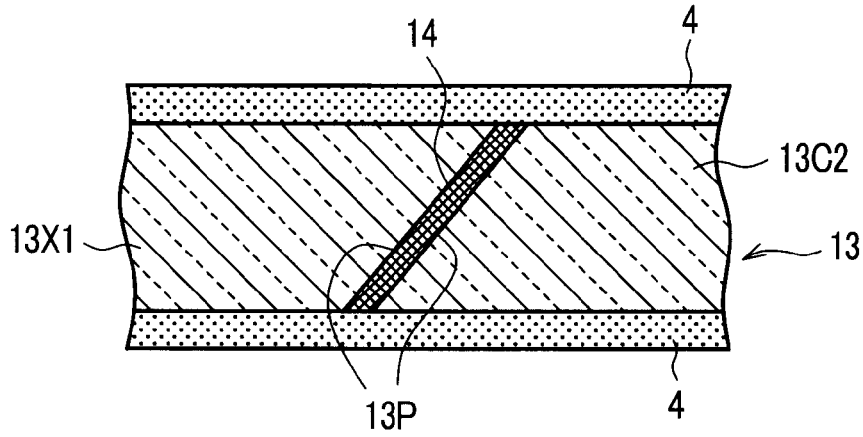
FIG. 2 is a cross-sectional view showing a portion A in FIG. 1 in an enlarged manner.

FIG. 1 is a developed perspective view which shows an embodiment of the image display device according to the present invention and also schematically explains a constitutional example of aback substrate, a face substrate and a support body. FIG. 2 is an enlarged cross-sectional view of a portion A in FIG. 1 as viewed in the Z direction. Here, the Z direction is a stacking direction of both substrates 1 and 2.

In this image display device, the back substrate 1 and the face substrate 2 are formed of a glass plate and the support body 13 is made of a glass material. Here, various constitutional components such as electron sources, phosphor layers and the like which are formed on respective inner surfaces of the back substrate 1 and the face substrate 2 are omitted from the drawing.

In FIG. 1 and FIG. 2, the back substrate 1 and the face substrate 2 are arranged to face each other with a fixed gap therebetween. The support body 13 having a given thickness is interposed between peripheries of the back substrate 1 and the face substrate 2. Further, both substrates 1, 2 and the support body 13 are sealed and fixed to each other using a sealing material 4 which is arranged on upper and lower end surfaces of the support body 13, thus, forming a sealed space which constitutes a display region in the inside thereof.

The support body 13 includes two long-side support body members 13X1 and 13X2, two short-side support body members 13Y1 and 13Y2, and four corner support body members 13C1, 13C2, 13C3, and 13C4, wherein these support body members are assembled into a shape and a size which allow them to surround the display region. Further, the support body members are hermetically bonded to each other at respective bonding surfaces 13P using a bonding material 14 such as glass frit. Further, in the above-mentioned constitution, the respective bonding surfaces 13P are formed in an oblique shape.

Here, with respect to the support body 13 which is an assembled body constituted of the support body members, it is desirable that a height of the support body 13 in the z direction is uniform over the whole surface of the whole circumference thereof. When the support body is configured to include a large stepped portion, the leaking of liquid crystal may arise.

Further, the bonding material 14 is made of glass frit which has properties different from properties of the sealing material 4.

That is, as an example of the bonding material 14, amorphous glass frit having a softening point of 440° C., for example, and a bonding temperature of 480° C. is used, while as the sealing material 4, amorphous glass frit having a softening point of 390° C. which is 50° C. lower than the softening point of the bonding material 14 and a sealing temperature of 430° C. is used.

Further, as another examples, the bonding material and the sealing material having following properties in Table 1 can be used.

TABLE 1

| Bonding material | Softening point | Bonding temperature |
|---|---|---|
| 14-2 | 475° C. | 530° C. |
| 14-3 | 521° C. | 575° C. |
| **Sealing material** | **Softening point** | **Sealing temperature** |
| 4-2 | 353° C. | 430° C. |
| 4-3 | 360° C. | 430° C. |

Although these frit glasses may have various compositions, for example, amorphous glass frit essentially consisting of PbO: 70 wt %, $B_2O_3$:4 wt %, $TiO_2$:9 wt % and the balance can be used—the control of the softening point of the glass frit can be performed by changing a quantity of oxide content. For example, when a quantity of oxide having a low melting point is large, the softening point becomes low, while when a quantity of oxide having a high melting point is large, the softening point becomes high.

Further, the technique to control the softening point by changing the composition ratio of the constituent contents of the glass frit is already disclosed in a handbook on glass or the like.

Due to the constitution of this embodiment, it is possible to easily form the support body members and the support body. Further, by forming the bonding surface defined between the support body members into an oblique shape, it is possible to ensure a large bonding area and, at the same time, the flowing out of the bonding material along the bonding surface can be prevented, thus, ensuring the reliability of the hermetic bonding.

Here, although the bonding material which exhibits the softening point difference of 50° C. with respect to the sealing material is used in this embodiment, even when the difference is small, the bonding material can be practically used so long as the softening point difference is at least 30° C. It is desirable that the softening point difference is 50° or more from a viewpoint of tolerance of bonding operation.

EMBODIMENT 2

Figure 3:
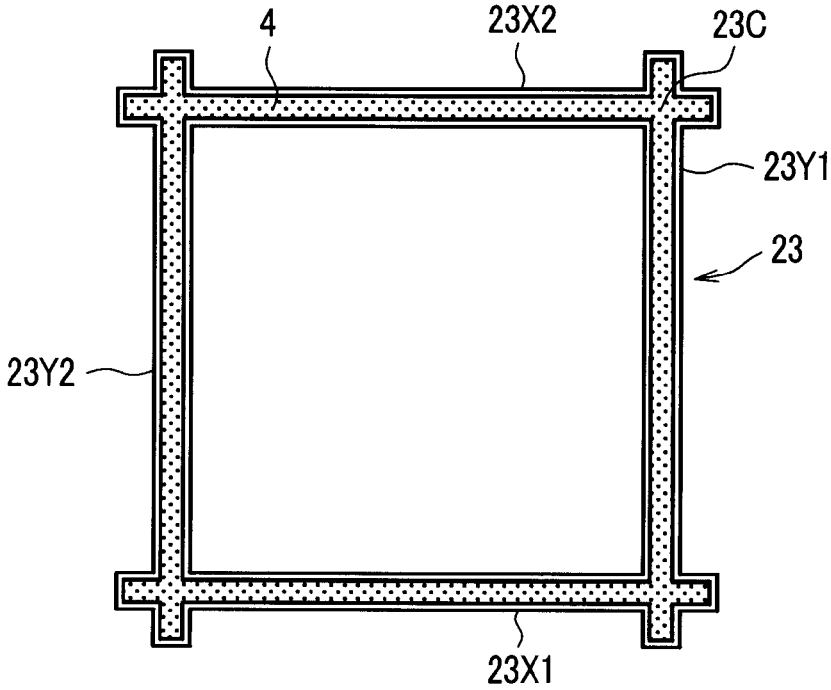
Figure 3:
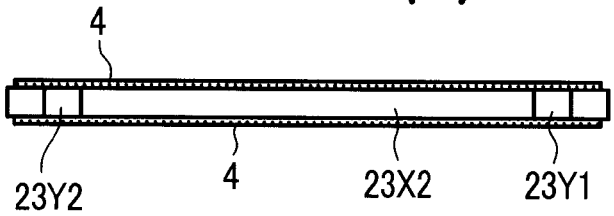

FIG. 3A and FIG. 3B show one example of a support body of another embodiment of an image display device according to the present invention, wherein FIG. 3A is a plan view and FIG. 3B is a front view. Parts identical with the parts shown in the above-mentioned drawings are given same numerals.

In FIG. 3A and FIG. 3B, a support body 23 is constituted by combining four rod-like support body members 23X1, 23X2, 23Y1, and 23Y2 in a projected-parallels shape and hermetically bonding them to each other at respective overlapped portions 23C using a bonding material 14.

Figure 4:
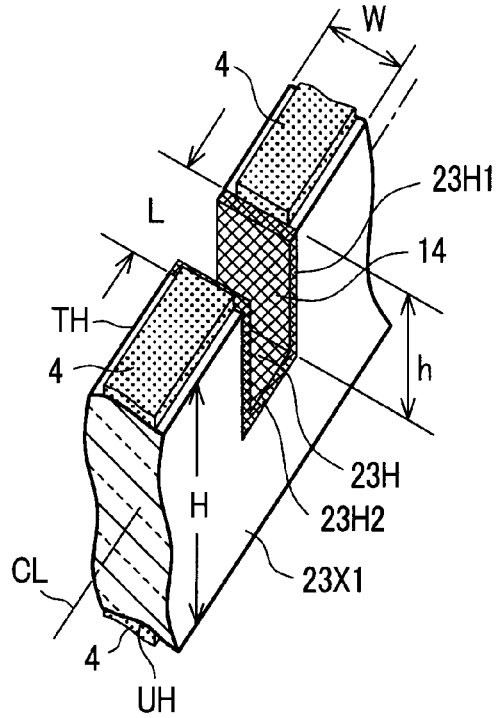
FIG. 4 is a perspective view of an essential part shown in FIG. 3A and FIG. 3B.

Each overlapped portion 23C includes a recessed portion 23H which is shown in FIG. 4 as one example, wherein the respective recessed portions 23H of the support body members to be combined are fitted to each other and are hermetically bonded to each other using the bonding material 14 which is interposed between opposite-facing surfaces of the support body members.

The recessed portion 23H shown in FIG. 4 shows an example of one end side of the support body member 23X1, wherein the recessed portion 23H has an opening having a length L over a full width W on a top surface TH of the support body member 23X1. Further, the recessed portion 23H extends toward a lower end surface UH while crossing a center axis CL at an approximately right angle and has a depth h which is approximately half of a height H of the support body member 23X1, thus, forming an approximately square hole shape. It is needless to say that the recessed portion 23H having the similar constitution is formed in the other end side. Further, other support body members 23X2, 23Y1, and 23Y2 also have the similar recessed portions 23H respectively at both end portions thereof.

The bonding material 14 is applied to an inner side wall 23H1 and a bottom surface 23H2 of the recessed portion 23H, and the support body member 23X1 and another support body member are hermetically bonded to each other using this bonding material 14.

The reason why this constitution is adopted is as follows. The shape of the overlapped portion is formed of the recessed portion having the approximately square shape with the opening on a top surface. Accordingly, the shape of the overlapped portion is simple and, hence, can be easily formed. Further, since the two-dimensional bonding can be achieved, the hermetic adhesion and fixing between the support body members can be ensured.

Further, since the support body members are fixed to each other two-dimensionally on the overlapped surface, at the time of sealing the support body and both substrates, in a portion or the whole of the evacuating step and the like, it is possible to ensure the desired hermetic property holding function even when a jig for holding the support body is not used.

EMBODIMENT 3

Figure 5:
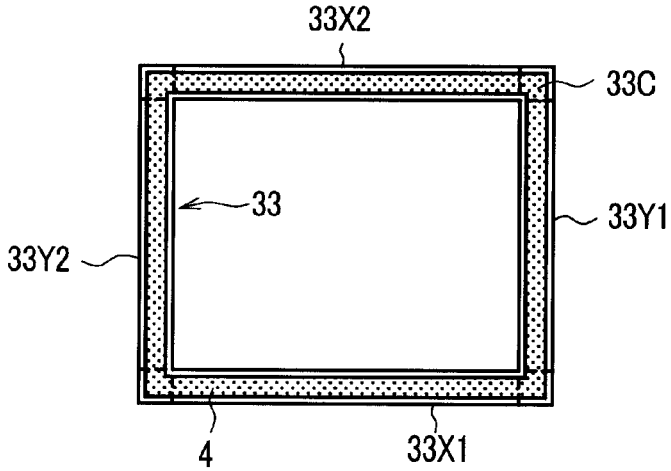
Figure 5:
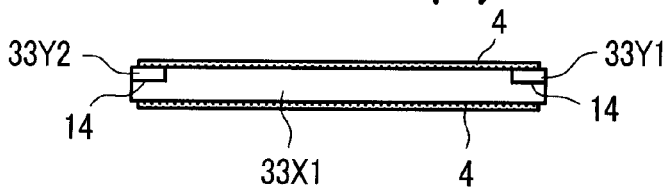

FIG. 5A and FIG. 5B show one example of a support body of still another embodiment of an image display device according to the present invention, wherein FIG. 5A is a plan view and FIG. 5B is a front view. Parts identical with the parts shown in the above-mentioned drawings are given same numerals.

In FIG. 5A and FIG. 5B, a support body 33 is constituted by combining four rod-like support body members 33X1, 33X2, 33Y1, and 33Y2 in a rectangular shape and hermetically bonding them to each other at respective overlapped portions 33C of respective end portions using a bonding material 14.

Figure 6:
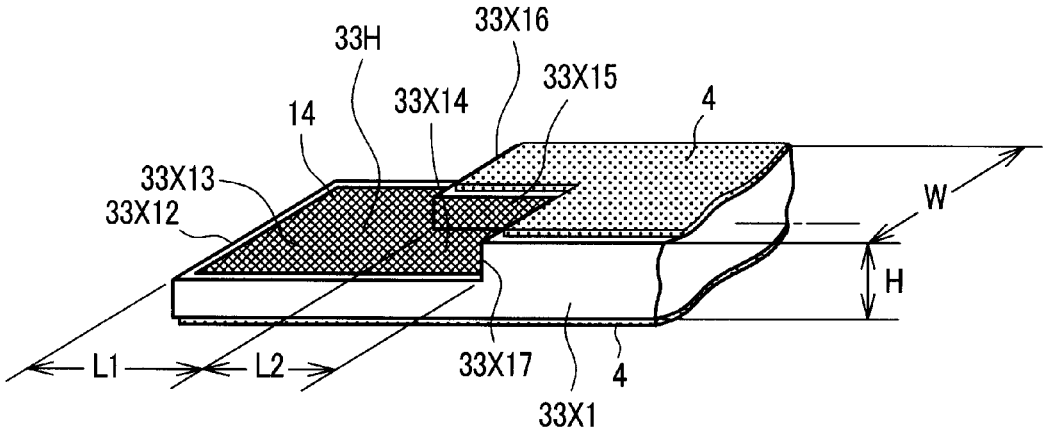
FIG. 6 is a perspective view of an essential part shown in FIG. 5A and FIG. 5B.

Each overlapped portion 33C includes a bonding portion 33H which is shown in FIG. 6 as one example, wherein the respective bonding portions 33H of the support body members to be combined are connected to each other and are hermetically bonded to each other using the bonding material 14 which is interposed between opposite-facing surfaces of the support body members.

The bonding portion 33H shown in FIG. 6 shows an example of one end side of the support body member 33X1. The bonding portion 33H is configured to include, on an end portion of the support body member 33X1, a first thin wall portion 33X13 which has a thickness approximately half of a height H of the support body member over a length L1 toward the longitudinal center from a longitudinal end surface 33X12, a second thin wall portion 33X14 having the same thickness as the first thin wall portion 33X13 over a length L2 inside the first thin wall portion 33X13 in a portion having a width approximately half of a width W of the support body member, a first wall portion 33X15 which is arranged parallel to the above-mentioned longitudinal direction, and second wall portions 33X16 and 3317 which are arranged orthogonally to the first wall portion 33X15. It is needless to say that the support body member 33X1 has the bonding portions 33H having a similar constitution on the other end side. Further, other support body members 33X2, 33Y1, 33Y2 are also respectively provided with the bonding portions 33H on both end portions respectively.

By applying the bonding material 14 to the first thin wall portion 33X13, the second thin wall portion 33X14, the first wall portion 33X15 and the second wall portions 33X16 and 33X17 of the bonding portion 33H, thereafter, the support body member 33X1 and other support body member are hermetically bonded to each other using the bonding material 14.

Due to such a constitution, the overlapped portions, per se, can be easily formed and, at the same time, due to the provision of the stepped portions (wall portions), it is possible to ensure the wide bonding area whereby the hermetic property holding function can be enhanced.

Further, since the support body members are fixed to each other two-dimensionally on the overlapped surface, at the time of sealing the support body and both substrates, in a portion or the whole evacuating step and the like, it is possible to ensure the desired hermetic property holding function even when a jig for holding the support body is not used.

EMBODIMENT 4

Next, the manufacturing method of the display device of the present invention is explained.

Figure 7:
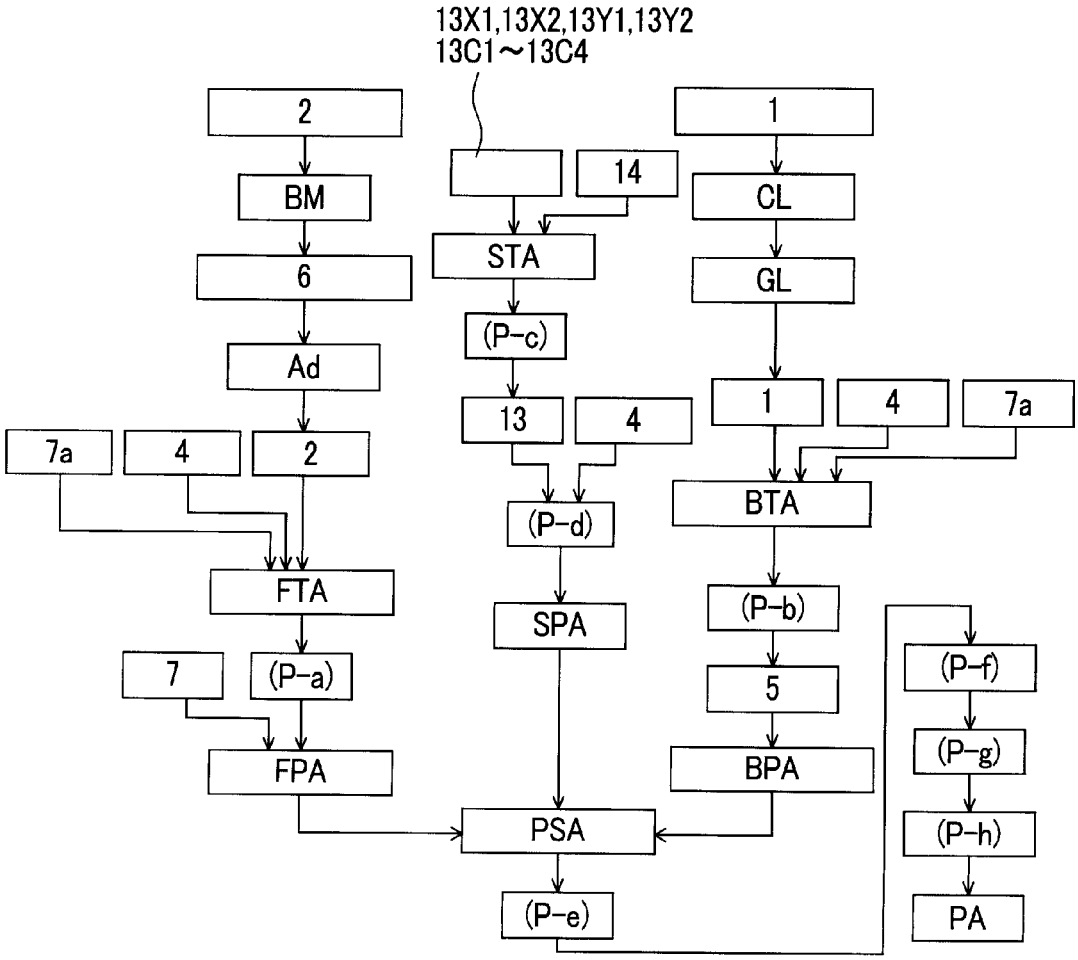
FIG. 7 is a flow chart for explaining a manufacturing method of an image display device according to the present invention.
Figure 8:
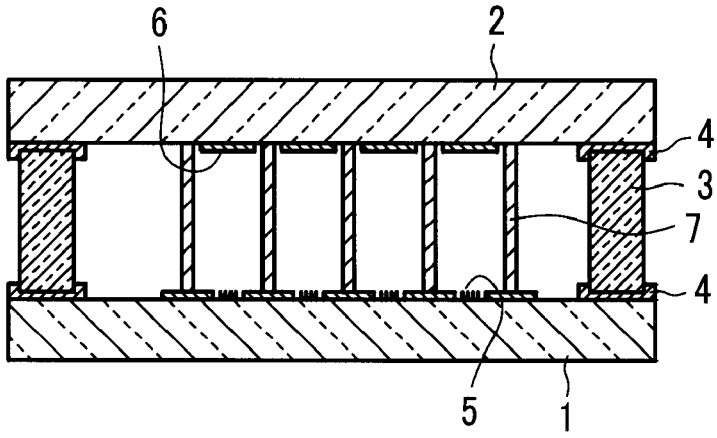
FIG. 8 is a cross-sectional view of an essential part showing the constitution of a conventional image display device.
Figure 9:
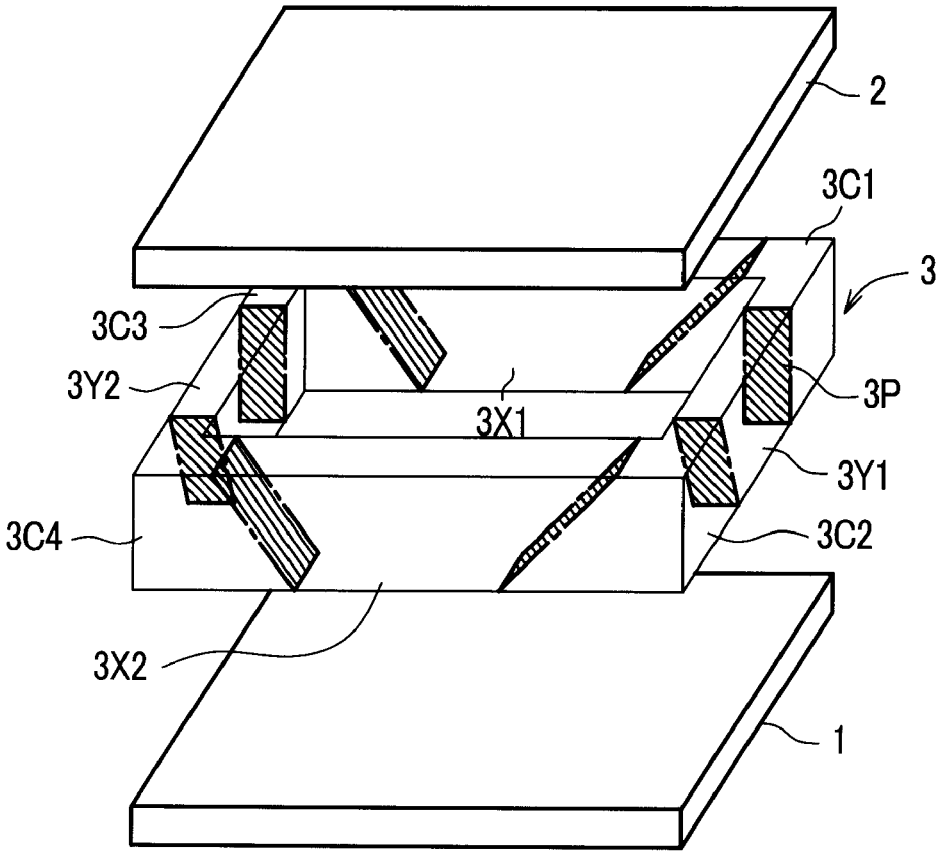
FIG. 9 is a developed perspective view for schematically explaining a constitutional example of the conventional image display device.
Figure 10:
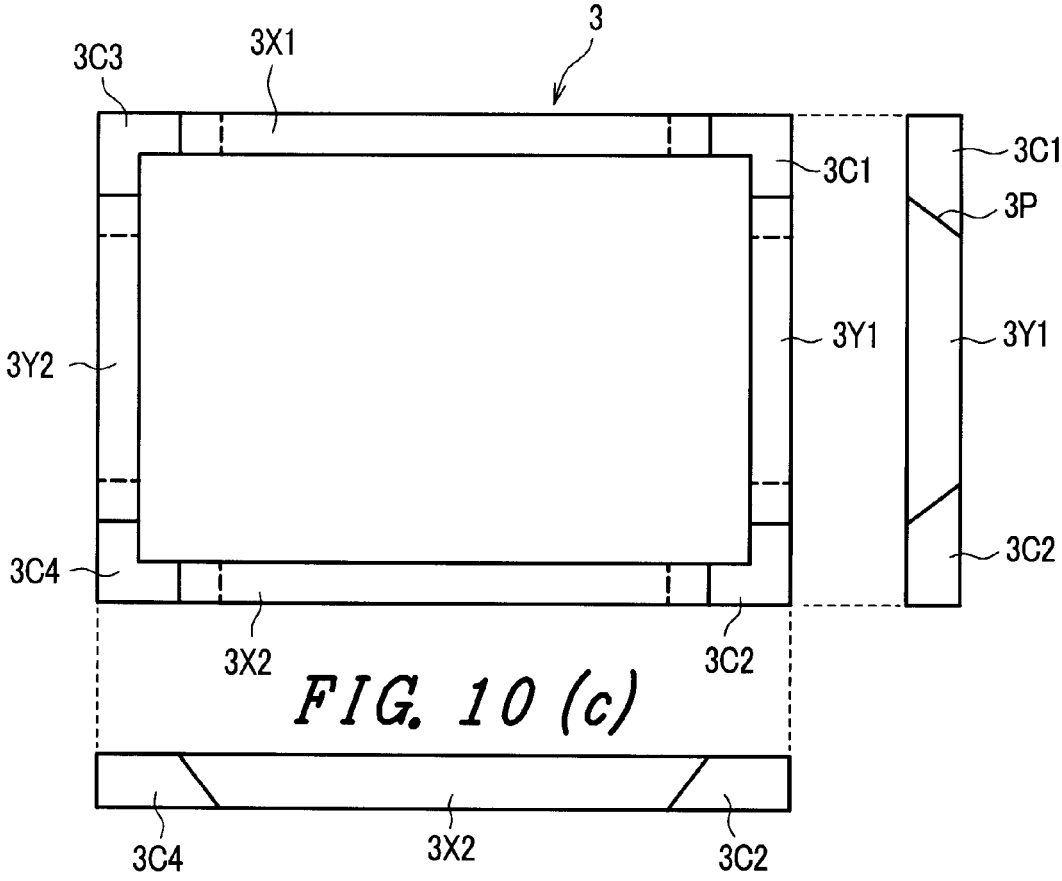
FIG. 10A, FIG. 10B and FIG. 10C are a plan view and two side views of a conventional support body shown in FIG. 9.

FIG. 7 is a flow chart for explaining the manufacturing method of the display device of the present invention, wherein parts which are identical with the parts shown in the above-explained FIG. 1 to FIG. 6 are given the same reference symbols.

In FIG. 7, on the face substrate 2, a phosphor surface which is constituted of a black matrix film BM, a phosphor pattern 6 and a metal back (anode) Ad is formed.

Next, to the face substrate 2 on which the phosphor surface is formed, a sealing material 4 which is formed by mixing amorphous glass frit and a given binder and a fixing material 7*a* for fixing the spacers 7 which is formed by mixing glass frit and a given binder, for example, are applied in given patterns, thus, forming a face substrate preliminarily assembled body FTA.

Here, it is possible to form all sealing material 4 on the support body 13 side without forming the sealing material 4 on the substrate.

This face substrate preliminarily assembled body FTA is preliminarily baked (P-a) at a temperature of approximately 150° C. which dissipates the binder and, thereafter, the fixing material 7*a* and the spacers 7 are positioned using jigs (not shown in the drawing) or the like. Then, the face substrate preliminarily assembled body FTA is heated at a temperature of, for example, 450° C. in the atmosphere for 10 minutes so as to fix one end surfaces of the spacers 7 to the face substrate 2 using the fixing material 7*a* thus, forming a face substrate assembled body FPA.

On the other hand, on the back substrate 1 side, first of all, a plurality of cathode lines CL which extend in one direction—for example, in the x direction—and are arranged in parallel in another direction which intersects one direction, —for example, in the y direction—control electrodes GL and the like are formed. Thereafter, the above-mentioned fixing material 7*a* and the sealing material 4 in which given binders are respectively mixed are applied and formed on the back substrate 1 side, thus, forming a back substrate preliminarily assembled body BTA.

Here, the fixing material 7*a* may differ in properties between the fixing material 7*a* used on the back substrate 1 side and the face substrate 2 side.

This back substrate preliminarily assembled body BTA is preliminarily (P-b) baked at a temperature of approximately 150° C. which dissipates the binder and, thereafter, the electron sources 5 are formed on the cathode lines CL, thus, forming a back substrate assembled body BPA.

On the other hand, the support body 13 is formed in a separate step described hereinafter.

That is, the respective support body members 13X1, 13X2, 13Y1, 13Y2, and 13C1 to 13C4 are set in the inside of the jig in a given arrangement in a state that the bonding material 14 which is formed of a paste produced by mixing amorphous glass frit having properties of, for example, a softening point of 440° C. and a bonding temperature of 480° C. and a given binder is interposed between each bonding surface 13P of the respective support body members, thus, forming the support body preliminarily assembled body STA. Then, the support body preliminarily assembled body STA is heated at the bonding temperature of 480° C. for 10 minutes under pressure, thus, forming the support body 13.

To both upper and lower end surfaces of the support body 13, that is, to the above-mentioned top surface TH and the lower end surface UH, the sealing material 4 which is formed of a paste produced by mixing amorphous glass frit having properties of, for example, a softening point of 390° C. and a sealing temperature of 430° C. and a given binder are applied, thus, forming the support body preliminarily assembled body STA. Then, the support body 13 is preliminarily heated at a temperature of approximately 150° C. which is a temperature sufficient to dissipate the binder thus forming the support body assembled body SPA.

Next, three assembled bodies constituted of the face substrate assembled body FPA which fixes one end surfaces of the spacers 7 to the face substrate 2, the back substrate assembled body BPA and the support body assembled body SPA are overlapped in the z direction, thus, forming a panel preliminarily assembled body PSA. In a state that the panel preliminarily assembled body PSA is pressurized in the z direction, the panel preliminarily assembled body PSA is heated (P-e) at a temperature lower than the softening point of the bonding material 14, for example, 430° C. for 10 minutes, thus, hermetically sealing (P-f) both substrates 1, 2 and the support body 13 using the sealing material 4. Another end surfaces of the spacers 7 is fixed to the back substrate 2 using the fixing material along with this hermetic sealing.

Next, the exhaust baking (P-g) is performed to evacuate the space which is surrounded by both substrates 1, 2 and the support body 13 and constitutes the display region, using an exhaust pipe not shown in the drawing. This exhaust baking is a step in which the panel preliminarily assembled body PSA is arranged in a vacuum furnace and is baked at a maximum temperature lower than the softening point of the bonding material, for example, 380° C. for several hours.

Further, in a mode which has no exhaust pipe, the above-mentioned exhaust baking can be performed simultaneously with the hermetic sealing.

Thereafter, in the constitution having the exhaust pipe, the exhaust pipe is tipped off after completion of the evacuation and the panel assembled body PA is manufactured through given treatment such as aging (P-h).

According to the above-mentioned manufacturing method, the treatment is performed at a temperature lower than the softening point of the bonding material 14 in the hermetic sealing using the sealing material 4 and the succeeding heating step and, hence, the melting and the softening of the bonding material 14 which hermetically bonds the support body members each other do not occur, whereby the support body members are firmly hermetically bonded with each other, thus, obviating the occurrence of the displacement and the leaking. Accordingly, the support body can sufficiently perform its function as the support body.

What is claimed is:

1. An image display device comprising:

a face substrate which forms an anode and a phosphor on an inner surface thereof;

a back substrate which forms a plurality of electron sources on an inner surface thereof and faces the face substrate with a given distance therebetween;

a support body which is interposed in a state that the support body surrounds a display region between the face substrate and the back substrate; and a plurality of spacers which maintain the distance between the face substrate and the back substrate within the display region, wherein end surfaces of the support body and the face substrate and the back substrate are hermetically sealed respectively using a sealing material, and the spacers are fixed to the substrate using a fixing material, and the support body is constituted of a plurality of support body members, and the support body members are hermetically bonded to each other using a bonding material, wherein a softening temperature of said bonding material is higher than a softening temperature of said sealing material,and a fixing temperature of said spacers is higher than a softening temperature of said sealing material.

2. An image display device according to claim 1, wherein the softening temperature of said bonding material is higher than the softening temperature of said sealing material by 30° C. or more.

3. An image display device according to claim 1, wherein the bonding material is made of glass frit.

4. An image display device according to claim 1, wherein the bonding material and the sealing material are made of glass frit.

5. An image display device according to claim 1, wherein said support body is made of glass.

6. An image display device according to claim 1, wherein the softening temperature of said bonding material is higher than the softening temperature of said sealing material by 50° C. or more.

* * * * *